US005476146A

United States Patent [19]

Brown

[11] Patent Number: 5,476,146

[45] Date of Patent: Dec. 19, 1995

[54] FIRE FIGHTING ALL TERRAIN VEHICLE

[76] Inventor: C. Coy Brown, 323 Florida SE., Albuquerque, N.M. 87108

[21] Appl. No.: 169,009

[22] Filed: Dec. 20, 1993

[51] Int. Cl.[6] ..... A62C 27/00

[52] U.S. Cl. ..... 169/24; 169/14

[58] Field of Search ..... 169/14, 15, 24, 169/25, 52; 137/267; 220/4.12, 4.13, 562, 564

[56] References Cited

U.S. PATENT DOCUMENTS

| | | | |
|---|---|---|---|
| 2,102,590 | 12/1937 | Gray et al. | 220/564 X |
| 2,539,663 | 1/1951 | Hague | 137/267 |
| 2,577,457 | 12/1951 | Freeman | 169/15 |
| 4,488,603 | 12/1984 | Schmittmann et al. | 169/24 |
| 4,593,855 | 6/1986 | Forsyth | 169/24 X |
| 4,875,526 | 10/1989 | Latino et al. | 169/24 |
| 4,917,193 | 4/1990 | Ockler | 169/24 |

*Primary Examiner*—Andrew C. Pike

[57] ABSTRACT

A fire fighting apparatus includes a vehicle, a first fluid tank supported on the vehicle, a second fluid tank supported on the vehicle at a different location than the first fluid tank, a pipe connecting the first fluid tank to the second fluid tank for causing a flow of a liquid between the first and second fluid tanks, a conduit extending from the first and second fluid tanks for passing the liquid in the tanks exterior of the vehicle, and a pump connected to the conduit for passing the liquid under pressure through the conduit. The vehicle is an all-terrain vehicle. A foam concentrate tank is connected to the conduit and positioned on the vehicle generally adjacent one of the first and second fluid tanks. The foam concentrate tank has a line extending to and communicating with the conduit. The conduit includes a first hose extending from the conduit and connected to a spray boom and a second hose extending from the conduit and connected to a spray gun. The second hose extends around a reel supported on a surface of the vehicle.

6 Claims, 3 Drawing Sheets

FIRE FIGHTING ALL TERRAIN VEHICLE

TECHNICAL FIELD

The present invention relates to apparatus for fighting fires. More particularly, the present invention relates to fire fighting equipment which is supported on vehicles for delivery to remote areas.

BACKGROUND ART

Current methods of fighting wildland and interface fires from the ground leave a significant gap in options available to fire fighters. On the low end of the gap, only fire fighters on foot are available. This option, by its nature, restricts fire fighting effectiveness to the limits of what individuals can accomplish without the benefit of mechanized aid. Personnel on foot are limited in distances they can travel and fire fighting equipment that can be carried to places where they are needed. Additionally, crews are essentially restricted to clearing fire lanes or setting "back" fires in an attempt to contain the fire. Either of these methods require surrendering significant amounts of area to the fire in order to provide enough time to make the fire break.

In general, there are major problems associated with fire fighting by personnel afoot. First, there is a very slow response time by such personnel. It often takes a great deal of time to reach the trouble area by foot. The safety of the personnel is an important concern. When such personnel are on foot, they are relatively unprotected and are often unable to leave the danger area promptly. The only fire fighting equipment that is available to such personnel afoot is fire fighting equipment that can be carried by the personnel. It is difficult to resupply the personnel in such inaccessible areas. In order to effectively fight the fire, a very high level of manpower is required. When the personnel are afoot, there is no structure to protect the personnel.

At the high end of the gap is the use of conventional pumper type vehicles which carry water, hoses, and pumps for fire fighting. The smallest of these vehicles use Ford Ranger size four wheel drive chassis equipped with tanks, pumps, and standard structure fire fighting equipment. These units are limited to a maximum of about 120 gallons of water onboard and require two persons to operate. Although the vehicles are off-road capable, they are relatively restricted in the area they can readily access. In rougher terrains, the vehicle speeds are greatly reduced and they are too large to enter much of the wildland growth density. Another problem is that the vehicle must (or should) be stopped When pumping water. Few of these vehicles are equipped to dispense foam. Those that do have foam capabilities are field retrofitted by whomever and perform with dubious, inconsistent results. Obviously, larger pumpers are almost entirely relegated to improved roads, require more personnel to operate, and cannot enter unknown small roads for fear of inability to turn around and exit the area. Application for this type of equipment is principally for fire fighting structure fires in relatively accessible areas with ample water supplies.

In the past, various U.S. patents have issued relating to fire fighting equipment which is supported on a mobile vehicle. For example, U.S. Pat. No. 4,593,855, issued on Jun. 10, 1986, to R. W. Forsyth describes a vehicle-mountable fire fighting apparatus which is designed to be quickly and easily mounted into an ordinary pickup truck. The fire fighting module includes a pump coupled to an engine for pumping a fire-retardant liquid. A reservoir tank is fluidically connected to the pump. The pumping equipment is positioned in the truck within the reach of the operator of the vehicle. An over-the-cab hose is detachably coupled onto a spray bar mounted onto the front of the truck.

U.S. Pat. No. 4,291,769, issued on Sep. 29, 1981, to E. Muller teaches a foam dispensing extinguishing unit for a rescue vehicle. This foam dispenser includes a container that contains a liquid adapted to be used for foam production. A device is connected to the container that feeds the fire extinguishing liquid, under pressure, from the container to a hand-held foam generating nozzle. A motor-driven pump or an air pressure device is coupled to the container so as to allow for the dispensing of the extinguishing liquid under pressure. Suitable valves and mechanisms are provided so as to allow the foam to be mixed with water so as to control the type of extinguishing liquid that is used. The unit is mounted in the back of a rescue vehicle.

U.S. Pat. No. 4,488,603, issued on Dec. 18, 1984, to Schmittmann et al. provides a compact foam dispensing fire fighting vehicle. This fire fighting vehicle includes a tank of water, a pump, and a spray nozzle. The vehicle is battery operated by the operator or by an electronic remote control device provided on the chassis. The device is described as being small enough to pass through normal a door opening so that it can enter a residence or a business.

U.S. Pat. No. 2,246,616, issued on Jun 24, 1941, to C. L. Cherry provides a truck which is designed to fight fires in a forest. This vehicle employs a plurality of axles that allow the vehicle to travel on varied terrain. This fire fighting vehicle includes its own supply of water, a pump, and a hose that is available for use in the extinguishing of the fire.

U.S. Pat. No. 3,840,074, issued on Oct. 8, 1974, to L. S. Clark teaches a fire fighting vehicle with multiple tanks designed to hold the ingredients for the production of foam.

OBJECTS OF THE INVENTION

It is an object of the present invention to provide a fire fighting apparatus that enhances the ability to fight fires effectively in remote locations.

It is another object of the present invention to provide a fire fighting apparatus that reduces the response time to wildland fires.

It is a further object of the present invention to provide a fire fighting apparatus that enhances the flexibility of the fire fighting capabilities from the vehicle.

It is still another object of the present invention to provide a fire fighting apparatus that facilitates the ability to resupply the vehicle with water.

It is still another object of the present invention to provide a fire fighting apparatus that provides some protection to the operator of the vehicle.

These and other objects and advantages of the present invention will become apparent from a reading of the attached specification and appended claims.

SUMMARY OF THE INVENTION

The present invention is a fire fighting apparatus that comprises a vehicle, a first fluid tank supported on the vehicle, a second fluid tank supported at a different location on the vehicle, a pipe connecting the first fluid tank to the second fluid tank so as to cause a restricted flow of a liquid between the first and second fluid tanks, a conduit extending from the fluid tanks for passing the liquid exterior of the vehicle, and a pump connected to the conduit for passing the liquid under pressure through the conduit.

The vehicle of the present invention is an all-terrain vehicle. Specifically, the term "all-terrain vehicle" means the vehicle has no less than four wheels and a turning radius of less than ten feet. The vehicle has a length of no more than ten feet and a width of less than four and a half feet. In one embodiment, the vehicle has a platform positioned at a rear end of the vehicle such that the first and second fluid tanks are positioned on this platform. In an alternative embodiment of the present invention, the vehicle has a first platform positioned at a forward area of the vehicle and a second platform positioned at a rear area of the vehicle. One of the fluid tanks is received on the first platform and the other fluid tank is received by the second platform. A foam concentrate tank is connected to the conduit and positioned on the vehicle generally adjacent to one of the fluid tanks. The foam concentrate tank has a line extending to and communicating with the conduit. The line is coupled to an induction-metering device on the conduit. The induction-metering device controls the flow of concentrate into the conduit. The pump is positioned forward of the line along the conduit. The pipe is connected to and communicates with the conduit. Specifically, the pipe is detachably connected to the conduit. The pump is positioned forward of the connection of the pipe and the conduit. The conduit specifically includes a conduit extending from the first and second fluid tanks, a first hose extending from the conduit and connected to a spray boom, and a second hose extending from the conduit and connected to a spray gun. The spray boom is attached to the vehicle at one end of the vehicle. The spray boom has a plurality of outlets directed downwardly. The spray gun is supported on the top side of the vehicle. The second hose extends around a reel positioned on the vehicle.

DETAILED DESCRIPTION OF THE INVENTION

Figure 1:
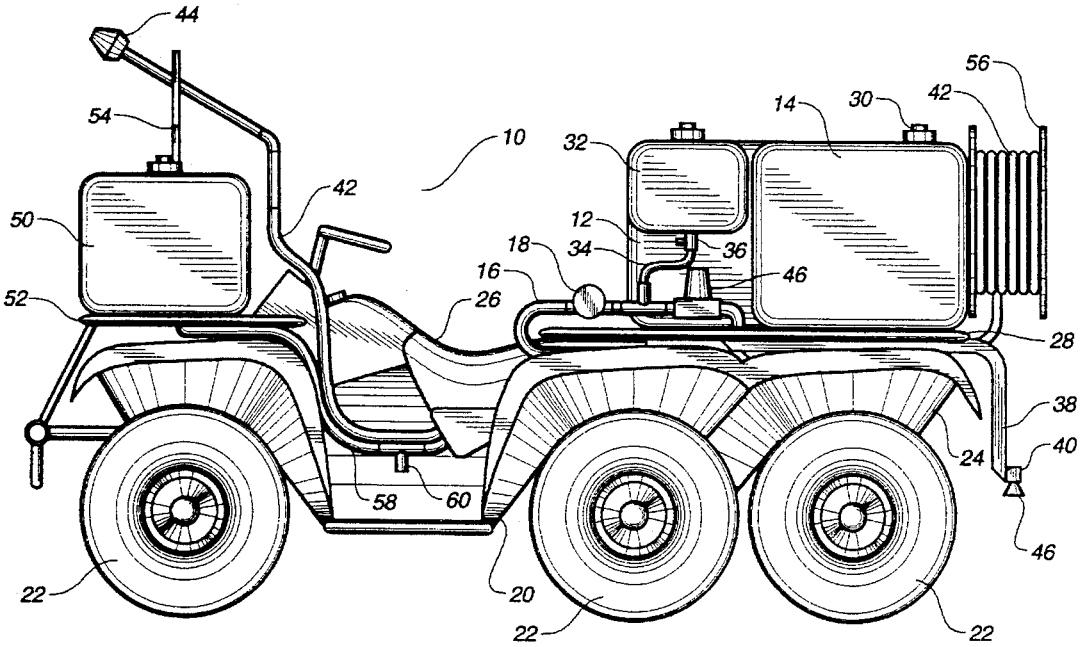
FIG. 1 is a side elevational view of the fire fighting apparatus in accordance with the preferred embodiment of the present invention.

Referring to FIG. 1, there is shown at 10 the fire fighting apparatus in accordance with the preferred embodiment of the present invention. Fire fighting apparatus 10 includes a first fluid tank 12, a second fluid tank 14, a conduit 16, a pump 18, and a vehicle 20.

As can be seen in FIG. 1, the vehicle 20 is an all-terrain vehicle. Specifically, the all-terrain vehicle 20 has six wheels 22 which allow the vehicle to traverse the earth in a proper fashion. Normally, the wheels 22 are rather large pneumatic wheels which allow the vehicle 20 to traverse various types of terrain. The chassis 24 of the vehicle 20 is supported above the wheels 22. The chassis 24 includes a passenger compartment 26 that allows an operator to sit comfortably therein. In this embodiment of the present invention, a platform 28 is provided at the rear of the vehicle 20. Platform 28 is used to support the fire fighting equipment on the vehicle.

The platform 28, positioned at the rear of the vehicle 20, supports the first fluid tank 12 and the second fluid tank 14. These fluid tanks 12 and 14 are used to receive a fire-retardant liquid, such as water. A cap 30 is shown attached to the top of the tank 14 so as to allow the tank 14 to be properly filled with the liquid. The fluid tank 12 will also include such a cap.

In FIG. 1, it can be seen that a foam concentrate tank 32 is also provided on the platform 28 and is supported adjacent to the first tank 12. The foam concentrate tank 32 contains a fire-retardant foam which is designed so as to be mixed with the water from the water tanks 12 and 14. As can be seen, a line 34 extends downwardly from the foam concentrate tank 32. A valve 36 is interposed between the line 34 and the foam concentrate tank 32.

The water tanks 12 and 14 are connected to the conduit 16 extending therefrom. The pump 18 is connected to this conduit 16. The conduit 16 extends to a first hose 38 which is connected to the spray boom 40. The conduit 16 is also connected to a second hose 42 which is connected to a spray gun 44. The spray boom 40 is attached to the vehicle 20 at one end of the vehicle. As can be seen, the spray boom 40 has outlets 46 directed downwardly. The spray gun 44 is supported on the top side of the vehicle 20.

A water filter 46 is provided along the conduit 16 so as to effectively filter water passing through the conduit 16 and the pump 18. The water filter 46 is of a conventional design. Water filter 46 is particularly important since one capability of the present invention is the ability to resupply with water in the field.

In FIG. 1, it can be seen that the forward end of the vehicle 20 includes an auxiliary water tank 50 supported on a forward platform 52 on the vehicle 20. It is important to note that the auxiliary water tank 50 can be a water tank or can be an equipment storage box. Alternatively, if needed, the auxiliary water tank 50 can be removed from platform 52. The illustration of the auxiliary water tank 50 is simply to indicate that there is space available on the vehicle 20 if larger capacities or storage requirements are needed. A support frame 54 is provided above the auxiliary water tank 50 so as to support the spray gun 44 on the top side of the vehicle. The support frame 54 can be configured so as to allow a controlled directing of the spray gun 44 during fire fighting activities.

In FIG. 1, it can be seen that a reel 56 is provided at the rear of the vehicle 20. The reel 56 receives the second hose 42 extending therearound. The reel 56 allows the hose 42 to be extended, as required. Importantly, the hose 42 and the wrapping of the hose 42 around the reel 56 provides a "mixing chamber" for the water and foam. As the water and foam are circulated from the respective tanks, they will pass into the hose 42 and will dynamically mix as they pass around and through the hose 42. The hose 42 will pass along the underside of the platform 28 at the rear of the vehicle and will extend toward the spray gun 44.

Additionally, in FIG. 1, it can be seen that a pipe 58 is connected between the auxiliary water tank 50 and the main water tanks 12 and 14. The pipe 58 allows for a flow of water between the auxiliary water tank 50 and the main water tanks 12 and 14. The pipe 58 facilitates equal usage of water from all tanks in order to balance the water load on the vehicle 20. As will be described hereinafter, a similar pipe 74 is connected between the water tanks 12 and 14 so as to assure the even balancing of the loads. Baffles, and other devices, can also be employed so as to avoid dangerous shiftings of the water load. The pipe 58 includes a drain 60 at its lowest point. Drain 60 facilitates the ability to remove water from the tanks, as required.

In FIG. 1, it can be seen that the pump 18 is positioned on the conduit 16 generally forward of the first hose 38 and the second hose 42. As such, the pump 18 serves to draw the water from the water tanks 12 and 14 and the foam from the foam concentrate tank 32. The foam and the water will pass into the conduit 16 for a delivery exterior of the vehicle 20. In the present invention, it is important to note that the line 34 extending from the foam concentrate tank 32 has a smaller diameter than the conduit 16. The line 34 is connected to an induction-metering device 35 on the conduit 36. The induction-metering device controls the flow of concentrate from the foam concentrate tank 32 into the conduit 16. The induction-metering device 35 has controlled sizes of internal passageways so as to provide a proper mix ratio. The diameter of the line 34 is typically one-eighth of an inch. The diameter of the conduit 16 is typically three-quarters of an inch. The diameter of the conduit 16 and the line 34 can be varied depending upon the requirements of the system.

Figure 2:
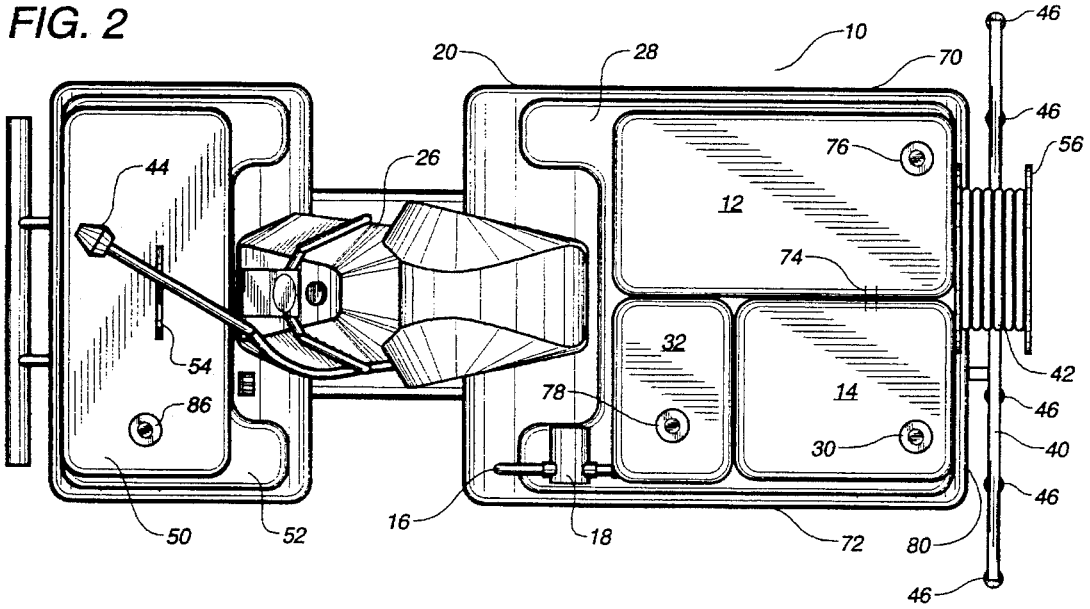
FIG. 2 is a plan view of the fire fighting apparatus in accordance with the preferred embodiment of the present invention.

FIG. 2 illustrates a plan view of the fire fighting apparatus 10. As can be seen, the first fluid tank 12 has a Greater size than the second fluid tank 14. The first fluid tank 12 is positioned adjacent to side 70 of the vehicle 20. The tank 14 is positioned adjacent to the side 72 of the vehicle 20. Because of the position of the tanks 12 and 14, it is necessary to control the shifting of the liquid from side to side in the tanks. A pipe 74 (illustrated diagramatically in FIG. 2) is provided between the tanks 12 and 14 so as to allow for equal water usage between the tanks. The size of pipe 74 is small enough to prevent load shifting between tanks. The foam concentrate tank 32 is positioned adjacent to the tanks 12 and 14. Caps 30, 76, and 78 are provided on the tanks 14, 12, and 32, respectively. The tanks 12, 14, and 32 are supported on the platform 28 at the rear of the vehicle 20.

The reel 56 is positioned at the back 80 of the vehicle 20. As can be seen, the spray boom 40 extends transverse to the longitudinal axis of the vehicle 10. The spray boom 40 includes a plurality of downwardly directed outlets 46. The outlets 46 serve to deliver the fire-retardant liquid directly to the surface of the Ground upon which the vehicle 20 is transversing.

The vehicle 20 is an all-terrain vehicle. As used herein, the term "all-terrain vehicle" is defined as a vehicle having no less than four wheels and a turning radius of less than ten feet. Additionally, the "all-terrain vehicle" should also have a length of less than ten feet and a width of less than four and a half feet. This small size and turning radius of the "all-terrain vehicle" facilitates the ability of the vehicle 20 to navigate in remote areas, in forests, and on irregular surfaces.

In FIG. 2, it can be seen that the auxiliary water tank 50 is supported on a platform 52 on the forward end of the vehicle 20. The support frame 54 on tank 50 receives the spray gun 44 therein. A cap 86 is provided on the top of the auxiliary water tank 50 so as to facilitate the filling of the water tank 50.

Figure 3:
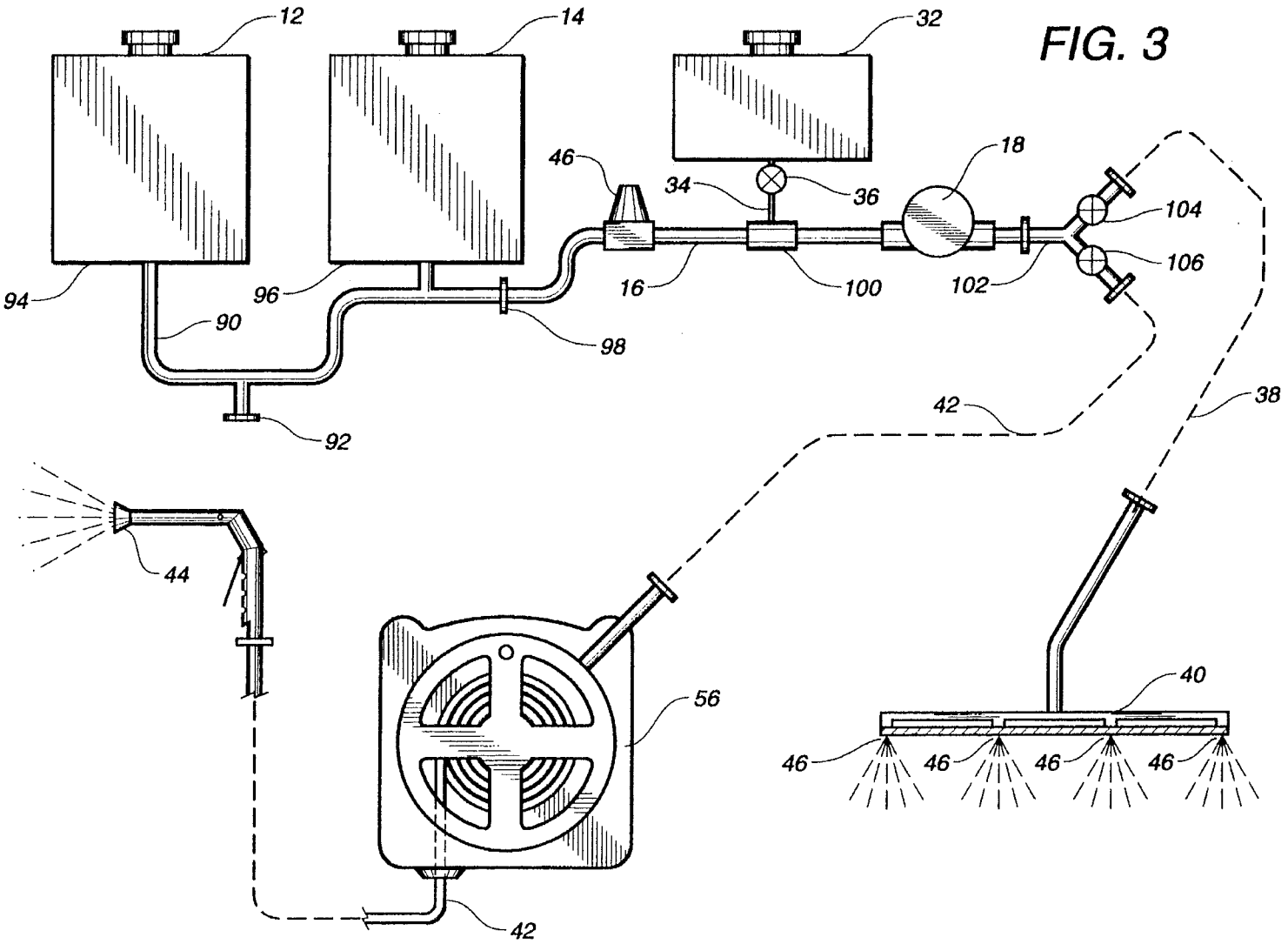
FIG. 3 is a flow diagram of the operation of the present invention.

FIG. 3 shows a fluid flow diagram of the system of the present invention. As can be seen, the fire fighting apparatus 10 of the present invention includes a first water tank 12, a second water tank 14, a conduit 16, a pump 18, a foam concentrate tank 32, a first hose 38, and a second hose 42. As can be seen, the first water tank 12 is connected by a pipe 90 to the second water tank 14. A drain 92 is provided along the pipe 90. The pipe 90 is specifically connected to the bottom side 94 of the first water tank 12 and to the bottom side 96 of the second water tank 14. The pipe 90 serves to allow for the flow of the water between the water tanks 12 and 14. Pipe 90 is connected to the conduit 16 at a hand disconnect coupling 98.

The conduit 16 has a water filter 46 attached thereto. The foam concentrate tank 32 is connected by line 34 to an induction/metering device 100 on the conduit 16. A valve 36 is provided at the bottom side of the foam concentrate tank 32 so as to act as an "on/off" switch for the flow of foam into the conduit 16. The pump 18 is positioned along the conduit 16 forward of the foam concentrate tank 32, the water tanks 12 and 14, and the water filter 46. As such, the pump 18 serves to "draw" the foam and the water from their respective tanks though the induction-metering device 100 in proper proportion. The conduit 16 is connected to a branch fitting 102. The branch fitting 102 is connected on one side to the hose 38 and connected on the other side to the hose 42. Suitable valves 104 and 106 are provided on the respective branches of the fitting 102. Hose 38 extends to the spray boom 40. It can be seen that the spray boom 40 includes a plurality of outlets 46 that serve to direct the flow of fire-retardant liquid downwardly of the spray boom. The second hose 42 acts as a mixing chamber for the foam and water and is stored on the reel 56 for convenience. The hose 42 then passes from the reel 56 toward the spray gun 44. The spray gun can be properly manipulated so as to specifically direct the fire-retardant liquid toward the fire. The manipulation of the valves 104 and 106 allows the operator of the vehicle to properly select the usage of the fire-retardant liquid and its application to the fire.

Figure 4:
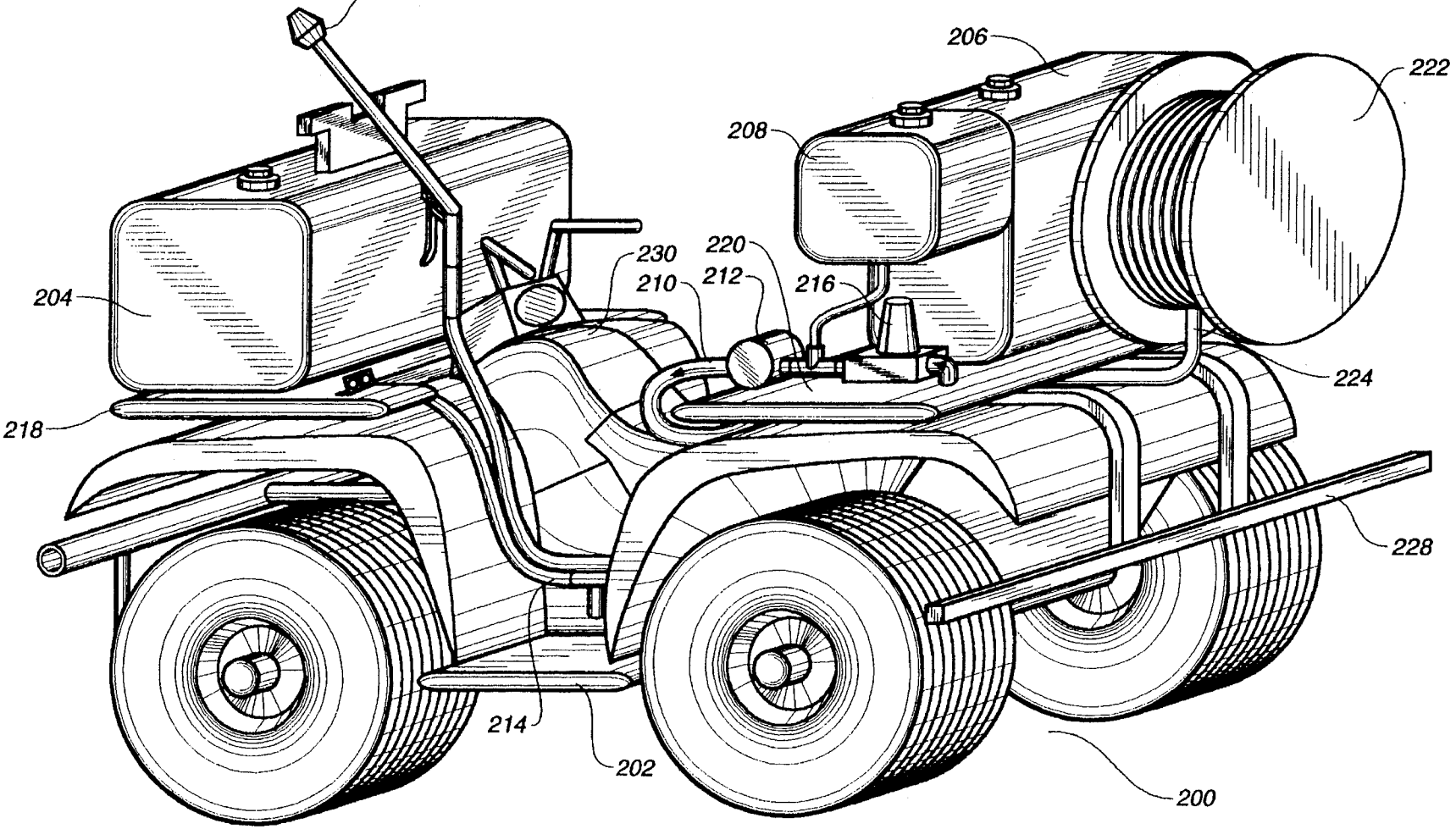
FIG. 4 is an oblique view of an alternative embodiment of the fire fighting apparatus of the present invention.

FIG. 4 shows an alternative embodiment of the fire fighting apparatus 200 of the present invention. The fire fighting apparatus 200 includes a vehicle 202, a first water tank 204, a second water tank 206, a foam concentrate tank 208, a conduit 210, a pump 212, a pipe 214, and a water filter 216. As can be seen, the first water tank 204 is positioned at the forward end on a platform 218 of the vehicle 202. The second water tank 206 is positioned on a rear platform 220 on the vehicle 202.

Since the operation of the vehicle 202 would be somewhat hazardous because of the large weight of the water contained within the water tanks 204 and 206, it is necessary to properly equalize the water levels so as to avoid an unbalanced load on the vehicle 202. This is accomplished through the use of the pipe 214 extending between the water tanks 204 and 206. The pipe 214 causes water to flow from one tank to the other. Baffles, and other devices, can be employed so as to preclude sudden shifting of the water load.

In FIG. 4, it can be seen that the reel 222 is supported at the rear of the vehicle 202. Hose 224 extends from the conduit 210 around the reel 222 and toward the spray gun 226. Similarly, the conduit 210 is connected to the spray boom 228. The pump 212 serves to deliver the fire-retardant liquid to either the spray gun 226 or the spray boom 228, or both. The foam concentrate tank 208 is positioned adjacent to the second water tank 206 at the rear of the vehicle 202.

In FIG. 4, it can be seen that the vehicle 202 is an all-terrain vehicle having four wheels. The vehicle 202 includes a passenger compartment 230 for the receipt of the operator.

With reference to FIG. 3, if it is necessary to fight a fire, the operator can simply manipulate the vehicle so as to drive the vehicle toward the scene of the fire. Since the vehicle is an all-terrain vehicle, it can traverse very remote areas to fight wildland fires. Prior to travelling to the remote area, the operator 10, at the operator's discretion, fills the water tanks 12 and 14, and the foam concentrate tank 32. Alternatively, if water supply is available at the scene, the operator of the vehicle may choose to drive the vehicle prior to filling the water tanks 12 and 14.

Once the operator is at the scene, the pump 18 is activated so as to draw water from the water tanks 12 and 14 into the conduit 16. The operation of the pump 18 will also cause the foam from the foam concentrate tank 32 to pass into the conduit 16. The fire-retardant liquid can then be passed outwardly by the activation of valves 104 and 106 toward the spray boom 40 and/or the spray gun 44. The spray gun 44 is utilized so as to direct a controlled flow of the fire-retardant liquid directly toward the fire. The spray boom 40 is used so as to deliver the fire-retardant liquid to the ground. In the event that the water tanks 12 and 14 become empty, then the operator of the vehicle can fill the water tanks at a remote location by disconnecting the conduit 16 from the pipe 90. The manipulation of the coupling 98 serves to properly carry out this operation. The open end of the disconnected conduit 16 can then be placed into the source of water. The pump 18 will then draw water from this source through the conduit 16. The valve 104 should be closed so that the entire flow of this water is passed into the hose 42 and toward the spray gun 44. The spray gun 44 is inserted into one of the openings of the water tanks 12 and 14 so that water can be directly delivered into the water tanks 12 and 14. The water tanks 12 and 14 will continue to fill since the pipe 90 properly connects the tanks. After the tanks have been filled, then the motor can be turned off and the coupling 98 reconnected to the pipe 90. As such, the apparatus of the present invention facilitates the remote use of the vehicle.

The present invention is a highly mobile, self-contained, self-propelled, and one person operable fire fighting apparatus. The all-terrain vehicle used by the present invention allows various implements, accessories, and devices to be attached which form a highly effective unit for use in fire fighting, suppression, containment, and mop-up activities. The operator has the ability to vary the induction rate of foam concentrate into the flow stream of water from zero to maximum at operator option. The adjustable spray gun provides the operator with the option to vary the application of water/foam from a full stream to fog with infinite variability between the two. For grass fires and low height vegetation fires, the operator may select the spray boom to apply the fire-retardant over a wider ground area. Additionally, the operator has the ability to engage or disengage the fire suppressant application while the vehicle is in motion. The vehicle has towing capability with a trailer hitch. A suitable trailer containing additional water, equipment, or other supplies may be towed by the vehicle. As a result, the apparatus and methods of the invention permit a single operator to effectively combat fires, lay down firebreak lines, protect exposed structures, and provide mop-up capabilities after fires have been brought under control. All of these fire fighting options are available in any order, combination, or intermixed while in operation in the fire theater with no time consuming adjustments required by the operator.

The foregoing disclosure and description of the invention is illustrative and explanatory thereof. Various changes in the details of the illustrated configurations may be made within the scope of the appended claims without departing from the true spirit of the invention. The present invention should only be limited by the following claims and their legal equivalents.

I claim:

1. A fire fighting apparatus comprising:

an all-terrain vehicle having no less than four wheels and a turning radius of less than ten feet, said vehicle having a length of no more than ten feet and a width of less than four and a half feet;

a first fluid tank supported on said vehicle;

a second fluid tank supported at a different location on said vehicle from said first fluid tank, said vehicle having a platform positioned at a rear end of said vehicle, said first fluid tank and said second fluid tank being positioned on said platform;

a pipe means connecting said first fluid tank to said second fluid tank, said pipe means for causing a restricted flow of a liquid between said first and second fluid tanks;

a conduit means extending from said first and second fluid tanks for passing the liquid exterior of the vehicle; and a pump means connected to said conduit means for passing the liquid under pressure through said conduit.

2. The apparatus of claim 1, further comprising:

a foam concentrate tank connected to said conduit means, said foam concentrate tank being positioned on said vehicle generally adjacent to one of said first and second fluid tanks.

3. The apparatus of claim 2, wherein said foam concentrate tank has a line extending to and communicating with said conduit means, said line connecting through an induction-metering device to said conduit, said pump means being positioned forward of said line along said conduit means.

4. The apparatus of claim 1, wherein said conduit means comprises:

a conduit extending from said first and second fluid tanks, said pump means being connected to said conduit;

a first hose extending from said conduit and being connected to a spray boom; and a second hose extending from said conduit and being connected to a spray gun.

5. The apparatus of claim 4, wherein said spray boom is attached to said vehicle at one end of said vehicle, said spray boom having outlets directed downwardly, said spray gun being supported on a top side of said vehicle.

6. The apparatus of claim 4, wherein said second hose extends around a reel, said reel being positioned on said vehicle.

* * * * *